United States Patent [19]

Capen

[11] Patent Number: 4,741,073

[45] Date of Patent: May 3, 1988

[54] COLLAPSIBLE HANDLE FOR CARTON

[76] Inventor: Thomas F. Capen, 6 Butler St., Cos Cob, Conn. 06807

[21] Appl. No.: 942,363

[22] Filed: Dec. 16, 1986

[51] Int. Cl.[4] ..... E05B 1/00

[52] U.S. Cl. ..... 16/114 R; 16/111 R; 16/110.5; 220/85 H; 220/94 R; 215/100 A

[58] Field of Search ..... 16/114 R, 110 R, 110.5, 16/111 R; 220/85 H, 94 R; 215/100 A; 224/148; 294/154, 157, 170, 32, 33, 153

[56] References Cited

U.S. PATENT DOCUMENTS

| | | | |
|---|---|---|---|
| 2,765,969 | 10/1956 | Bennington | 220/85 H |
| 2,812,968 | 11/1957 | Sevener | 215/100 A |
| 2,922,558 | 1/1960 | Harvey | 16/114 R |
| 2,973,989 | 3/1961 | Harwood | 294/154 |
| 3,086,806 | 4/1963 | McAndrew | 215/100 A |
| 3,262,618 | 7/1966 | Miller | 294/33 |
| 3,615,115 | 10/1971 | Simms | 16/114 R |
| 4,120,073 | 10/1978 | Studebaker | 16/114 R |

FOREIGN PATENT DOCUMENTS

| | | | |
|---|---|---|---|
| 2305357 | 10/1976 | France | 220/85 H |

*Primary Examiner*—Nicholas P. Godici
*Assistant Examiner*—Gerard M. Reid
*Attorney, Agent, or Firm*—Alfred E. Miller

[57] ABSTRACT

A compact, collapsible handle attachment for a rectangular carton having rectangular-shaped wire bands which are pivotable or swingable in holes in the handle end blocks. As the weighted carton is lifted, the handle end blocks slip upwardly on one side of the carton while the bight portions of the wire bands more firmly frictionally engage the front edges of the carton to thereby prevent slippage of the handle-holder off the carton when the same is raised.

7 Claims, 2 Drawing Sheets

COLLAPSIBLE HANDLE FOR CARTON

The present invention relates to a collapsible handle attachment for a rectangular or square carton, such as a half gallon milk carton. The handle attachment can be inserted over a carton and used for lifting the same, and removed from the carton and installed for use on another carton, as desired.

It is the object of the present invention to provide a removable handle attachment for a carton of rectangular configuration which tightly engages the carton for lifting the same, without slippage, and for dispensing the contents thereof, and removal from the carton after the contents have been dispensed. Another feature of the present invention is the provision of relatively rigid rectangular-shaped wire bands, each of which are of one piece construction with the free end thereof passing through an opening in the top and bottom end blocks of the handle and bent over thereon. The wire bands can be collapsed into superposed relationship against the handle portion and held on opposite walls of the end blocks of the handle.

Another object of the present invention is to provide a rectangular-shaped and relatively rigid wire band which conforms to the shape of the carton and is slightly larger than said carton so that the wire can snuggly fit over the carton and held by friction due to the lifting action of the handle with the weighted carton attached, whereby the wires are frictionally held on the carton thereby preventing the carton from slipping out from the handle-holder attachment.

It is another object of the present invention to provide an attachable handle for a milk carton, or the like, which is light in weight, compact in size, and easily affixed to the carton and removed therefrom.

It is the further object of the present invention to provide a handle attachment for a rectangular-shaped carton which collapses when not in use for storage, and for easy packaging and transportation.

In order that the present invention will be more clearly understood, it will now be disclosed in greater detail with reference to the accompanying drawings, in which.

Figure 1:
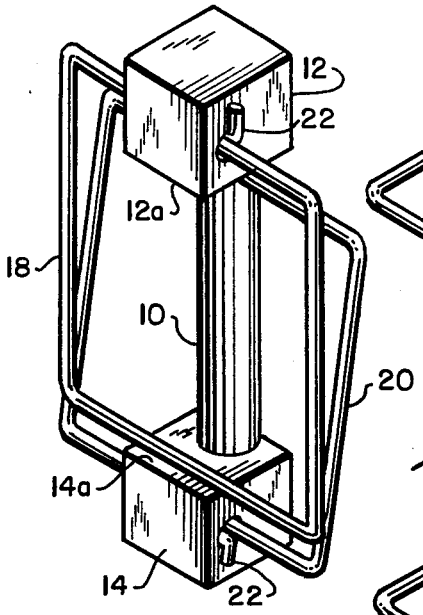
FIG. 1 is a perspective view of the handle attachment for a rectangular-shaped carton in which the wire bands are collapsed on the end blocks of the handle and are held thereagainst by friction.
Figure 2:
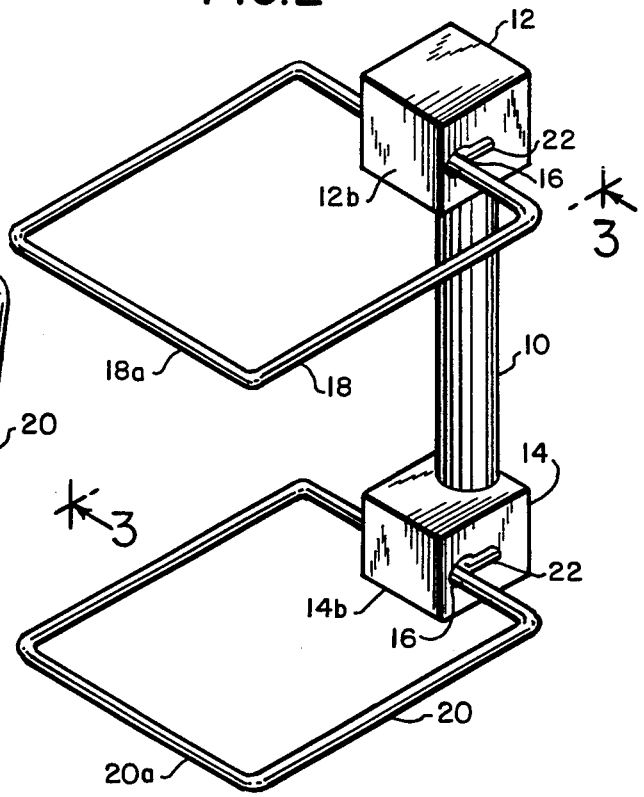
FIG. 2 is a perspective view of the handle attachment for a rectangular-shaped carton in which the wire bands are extended in position for attachment to a carton.

The collapsible handle-holder for a rectangular-shaped carton, such as a milk carton, in which the handle 10 may be fabricated of plastic, wood, medal or any other suitable material, and is shown here in cylindrical form, however, it is obvious that the handle may be square or any other shaped form that is suitable for gripping by the hand without slippage. The handle 10 is provided at each end with rectangular-shaped blocks 12 and 14 which may be made of plastic, wood, medal or any other suitable material and through which a hole 16 is drilled. As seen in the drawing, rectangular-shaped wire bands 18 and 20 are shown, which may be fabricated of metal, plastic or other suitable material which are rigid but are slightly bendable. The free ends of the wires 22 are bent out of the plane of the adjacent wire band portions and each consequently extends along an adjacent side surface of the blocks 12 and 14. Since the wire bands are somewhat bendable, the portions of the wire band adjacent to the ends 22 can be moved in a limited fashion within the hole 16.

Figure 3:
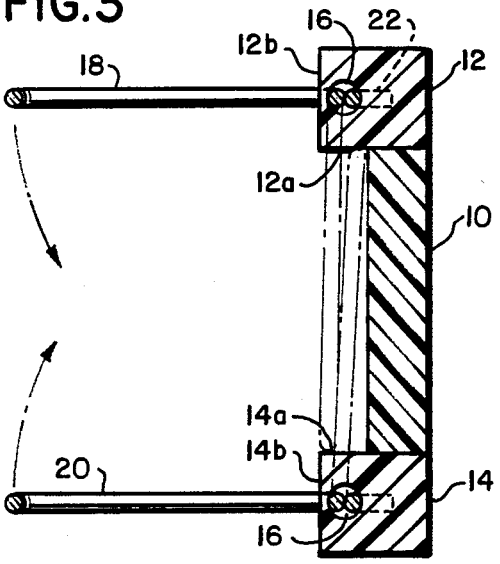
FIG. 3 is a sectional view taken along the lines of FIG. 2, showing the wire bands in both an extended condition as well as in a collapsed condition.

As seen in FIG. 1, the wire bands 18 and 20 can be collapsed toward the handle 10, and the portions 18*a* and 20*a* can be moved to the position shown in FIG. 1, in which they frictionally engage surfaces 12*a* and 14*a* of the end blocks 12 and 14, respectively. In this manner, the handle device is readily available for easy packaging and transportation. It should be evident that FIG. 3 shows the wire band in its extended position in full lines, and in its collapsed position in dot dash lines.

Figure 4:
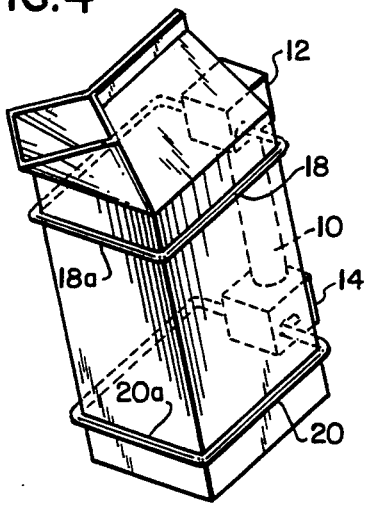
FIG. 4 is a perspective view of the handle attachment employed on a carton, such as a half gallon milk carton.
Figure 5:
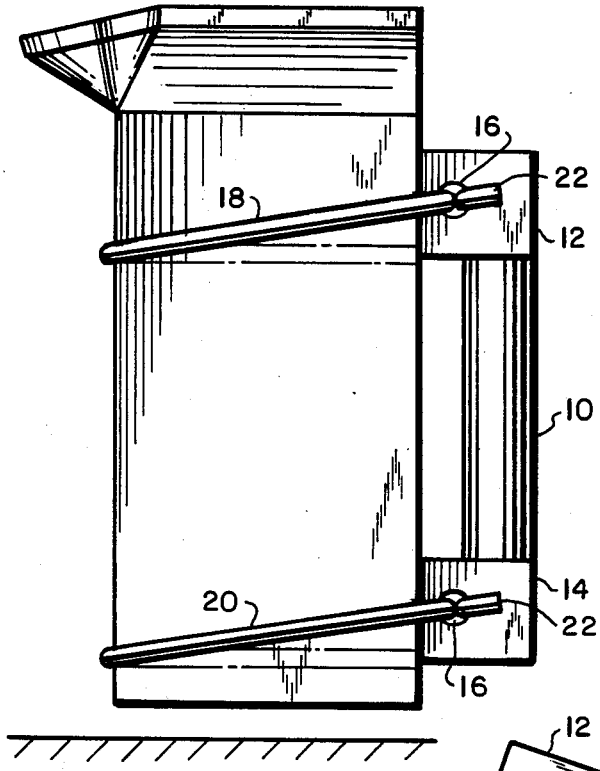
FIG. 5 is an enlarged side elevational view of the handle shown attached to a carton, such as a one half gallon milk carton, and indicating the two positions thereof.
Figure 6:
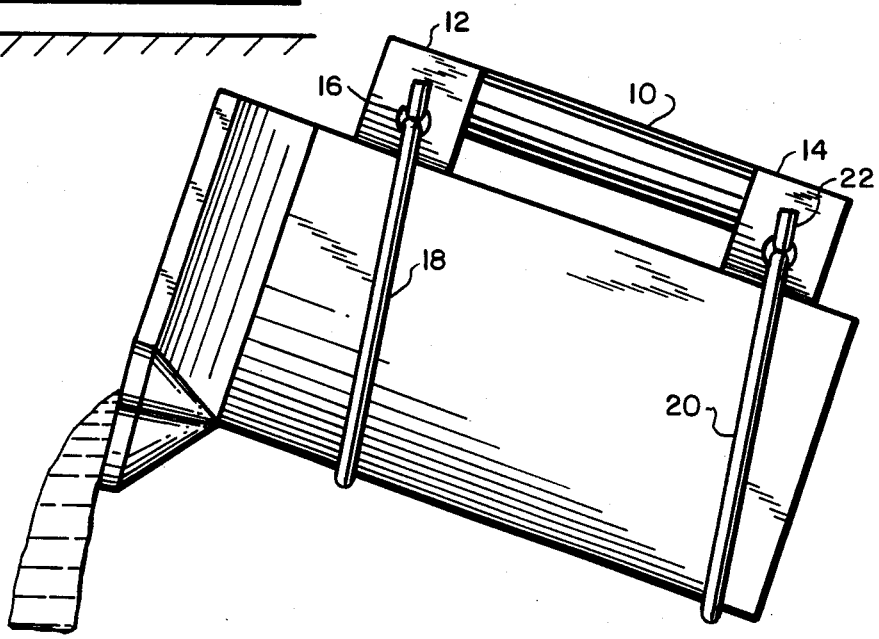
FIG. 6 is another side elevational view showing liquid being poured from the carton which is tilted for that purpose.

In FIGS. 4, 5 and 6 the collapsible handle attachment is shown applied to a rectangular-shaped carton. In this connection, and referring especially to FIGS. 5 and 6, it will be seen that the wire band assumes the full line position when the carton is lifted by the handle 10 since the wire bands are freely swingable within the holes 16. Thus, when a weighted carton, for example a milk carton filled with milk is lifted after the wire bands are placed over the carton from a position in which the carton is at rest on a flat surface, as seen in dot dash lines in FIG. 5, to a position in which the wire bands are shown in full lines in FIG. 5, the surfaces 12*b* and 14*b* of the blocks 12 and 14, which are adjacent to a flat side surface of the carton, slides upwardly. This movement increases the frictional contact between the parts 18*a* and 20*a* of the wire bands 18 and 20 respectively on the front part of the carton, and especially the front edges, as well as the surfaces 12*b* and 14*b* on the rear part of the carton.

As seen in FIG. 6, the handle facilitates the pouring of the liquid or other substances out of the carton, while maintaining a firm grip on the carton with little or no likelihood of slippage. It should also be noted that the flat surfaces 12*b* and 14*b* of the blocks 12 and 14 which engage a corresponding flat surface of the carton function to give stability to the handle device and easy control of the pouring out of the contents of the container.

It will also be noted that the wire bands 18 and 20, as seen in FIGS. 4–6, can be moved to positions in which the upper band 18 is manually pushed downwardly on the carton while the lower band 20 is manually pushed upwardly on the carton so that each of the bands have increased frictional grip on the carton whereby the handle remains in a stationary position on the carton, and will not slip when the carton is lifted and tilted for pouring.

It is obvious that the present device facilitates handling and pouring of the weighty contents from cartons, the handle device collapses when not in use for storage, and is easily transferable, light in weight, and easy to affix and to remove from a rectangular-shaped carton.

While the invention has been disclosed and described herein with reference to a certain embodiment of the invention, it is apparent that variations and modifications may be made which will fall within the true spirit and scope of the invention as defined in the following claims.

I claim:

1. A detachable handle for a weighted carton comprising two spaced end blocks, each having a hole therethrough, a hand gripping part intermediate said end blocks and connected thereto whereby a recess is formed in space bounded by said hand gripping part and said spaced end blocks, a pair of band elements, each having their free end parts passing through the respective hole in one of said end blocks and provided with means for holding each of said band elements in their respective hole whereby said bands are freely pivotal in said hole so that when the bands are placed over said carton in an extended position at spaced locations thereon and the carton lifted by said handle, said bands move to a position to frictionally grip said carton, said bands being capable of being collapsed to a superposed position in said recess, and said bands being generally of fixed dimensions such that when said bands are in a superposed position in said recess a part of each of said bands remote from the end block through which said band passes will always be frictionally engaged by a surface of the other end block when collapsed in said recess.

2. A detachable handle as claimed in claim 1 wherein said bands are rectangular-shaped.

3. A detachable handle as claimed in claim 2 wherein said bands are fabricated of a slightly bendable wire material.

4. A detachable handle as claimed in claim 1 wherein said intermediate hand gripping part and said two end blocks of said handle are integral.

5. A detachable handle as claimed in claim 2 wherein said weighted carton is a rectangular-shaped carton.

6. A detachable handle as claimed in claim 1 wherein said means for holding the band elements in respective holes are extreme end portions thereof that are bent out of the plane of the adjacent end part.

7. A detachable handle as claimed in claim 2 wherein said end blocks move up a side surface of said carton upon lifting said carton while parts of said rectangular-shaped bands remain at approximately the same location on said carton to thereby increase the frictional grip on said carton.

* * * * *